US005657927A

United States Patent [19]

Bushman et al.

[11] Patent Number: 5,657,927

[45] Date of Patent: Aug. 19, 1997

[54] FRUIT PROCESSING MACHINE

[75] Inventors: Ronald C. Bushman, Brea; William E. Harris, Jr., Fontana, both of Calif.

[73] Assignee: Brown International Corporation, Covina, Calif.

[21] Appl. No.: 409,325

[22] Filed: Mar. 23, 1995

[51] Int. Cl.[6] ..... B05B 3/04

[52] U.S. Cl. ..... 239/240; 99/501; 99/516; 239/601; 134/180

[58] Field of Search ..... 99/509, 510, 516, 99/536; 134/167 R, 180, 181, 168 R; 239/237, 240, 597, 598, 601

[56] References Cited

U.S. PATENT DOCUMENTS

| | | | |
|---|---|---|---|
| 575,966 | 1/1897 | Main | 239/240 |
| 1,335,267 | 3/1920 | Ambrose | 239/598 |
| 1,730,658 | 10/1929 | Jensen | 134/168 R |
| 3,698,029 | 10/1972 | Pulliam | 134/180 |
| 3,733,030 | 5/1973 | Carstenson | 239/240 |
| 3,737,108 | 6/1973 | Stumphauzer et al. | 239/598 |
| 4,078,727 | 3/1978 | Lingnau . | |
| 4,421,021 | 12/1983 | Holbrook | 99/509 |
| 4,471,908 | 9/1984 | Hunter . | |
| 4,559,653 | 12/1985 | Mathews | 239/240 |
| 4,681,260 | 7/1987 | Cochran et al. . | |
| 4,708,290 | 11/1987 | Osmond | 239/240 |
| 4,732,304 | 3/1988 | Yoshihara et al. . | |
| 4,732,325 | 3/1988 | Jensen et al. . | |
| 4,802,628 | 2/1989 | Dautel et al. . | |
| 4,834,292 | 5/1989 | Dyck . | |
| 4,913,346 | 4/1990 | Nakamura et al. . | |
| 4,989,786 | 2/1991 | Kränzle et al. . | |
| 5,088,393 | 2/1992 | Nahir et al. | 99/516 |
| 5,104,044 | 4/1992 | Ratell, Jr. . | |
| 5,143,105 | 9/1992 | Katayama . | |
| 5,217,166 | 6/1993 | Schulze et al. . | |
| 5,265,806 | 11/1993 | Ferrarini . | |

*Primary Examiner*—David Scherbel
*Assistant Examiner*—Terrence Till
*Attorney, Agent, or Firm*—Lyon & Lyon

[57] ABSTRACT

A washer for a fruit processing machine includes a rotary nozzle paddlewheel gear mounted in a nozzle housing. The rotary nozzle paddlewheel gear meshes with combination gears which in turn mesh with a wash nozzle. Fluid pumped into the housing drives the gears and blows out through the rotary wash nozzle creating a spray pattern. As the rotary wash nozzle completes a revolution, a hemispherical or larger region is sprayed by the fluid, cleaning the equipment to be washed.

8 Claims, 4 Drawing Sheets

FRUIT PROCESSING MACHINE

BACKGROUND OF THE INVENTION

1. Field of the Invention

The field of the invention is fruit processing machines.

2. Background

In the automated process of extracting juice and pulp from fruit, substances such as skins, pulp, rag, and seeds are left behind on the surfaces of the fruit processing machine. These by-products must be removed periodically to maintain juice quality.

Various methods have been used to clean fruit processing machines. Manual Cleaning, using a hose and brush, is labor intensive, slow, and inefficient. Certain fruit processing machines or juice extractors have been equipped with spray nozzles, fixed in certain positions. For cleaning, water is forced under high pressure through the spray nozzles. The water rushing through the nozzles is directed at the inner surfaces of the machine. Water strikes the inner surfaces of the machine with high impact and dislodges and washes away residual juice, skins, pulp, and seeds, thereby cleaning the machine.

While usually more efficient than manual methods, the use of fixed nozzles has various disadvantages. A large number, typically hundreds, of conventional fixed nozzles may be required to wash all areas of the machine properly. Equipping a machine with this large number of nozzles is in itself an undesirable expense. In addition, the large number of nozzles, all spraying with high impact, requires the use of a very high volume of wash water which is undesirable for the environment and increases the cost of operation. For the foregoing reasons, there is a need for a fruit processing machine having an improved cleaning system.

SUMMARY OF THE INVENTION

To these ends, a fruit processing machine has a washer with a nozzle housing. Preferably, a rotary nozzle paddlewheel gear is mounted in the nozzle housing. Water forced into the nozzle housing causes the rotary nozzle paddlewheel gear to rotate. A plurality of combination gears providing gear reduction is advantageously enmeshed with the rotary nozzle paddlewheel gear. In a preferred embodiment, one of the combination gears meshes with a rotary wash nozzle. The nozzle most desirably has a first wedge-shaped or tear drop shaped spray opening at a hemispherical end, and a second flat spray opening on a cylindrical body, of the nozzle.

Accordingly, it is an object of the present invention to provide a fruit processing machine having an improved cleaning system. Other and further objects and advantages will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
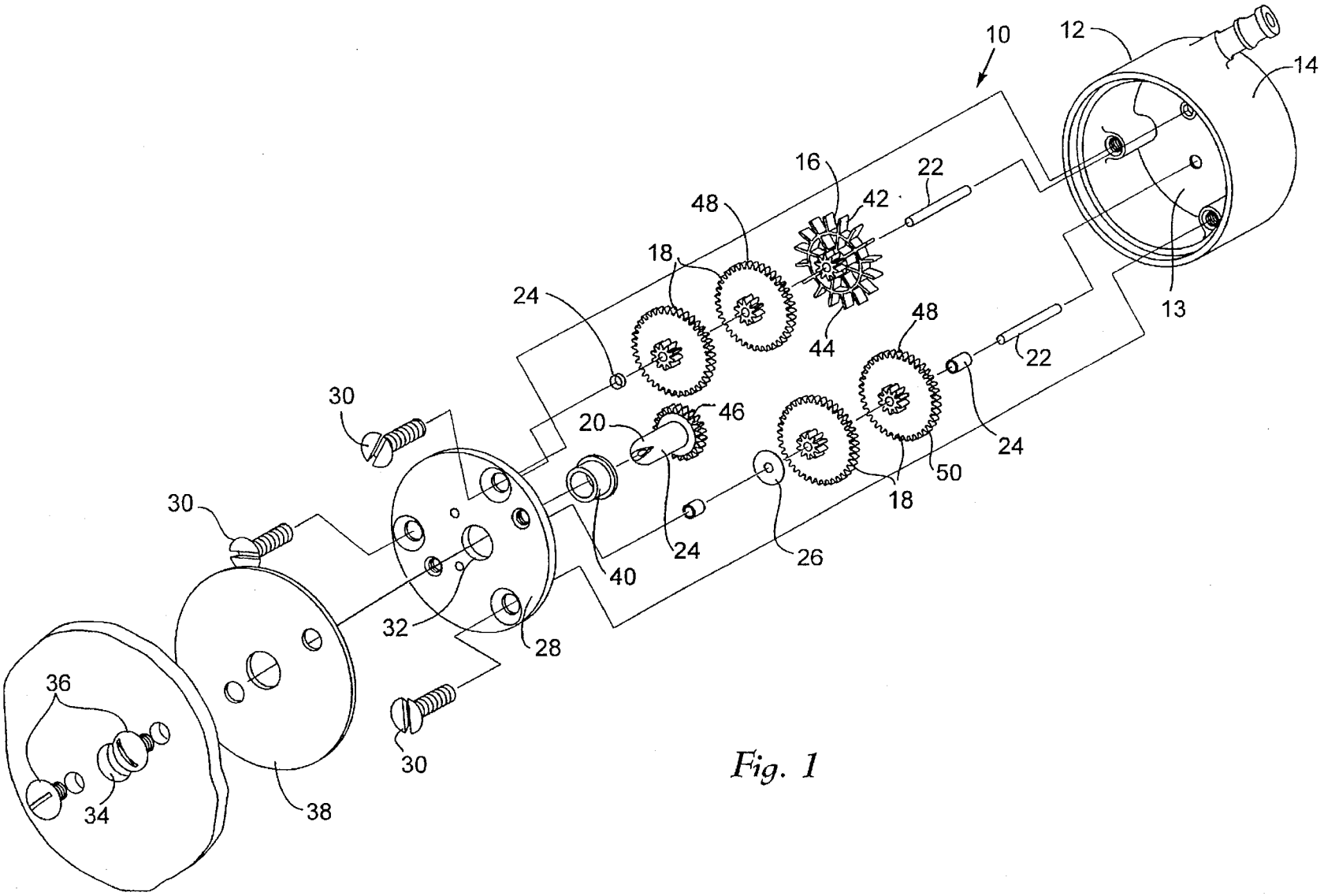
FIG. 1 is an exploded perspective view of the present fruit processing machine washer.
Figure 2:
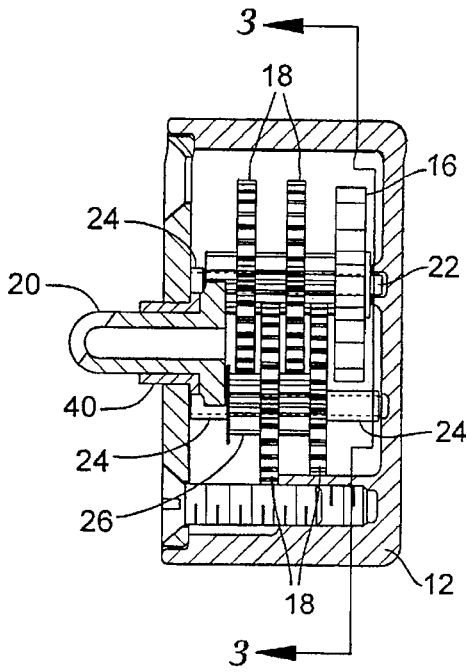
FIG. 2 is a side section view thereof illustrating the spatial relation of the rotary nozzle paddlewheel gear to the combination gears and the rotary wash nozzle.
Figure 3:
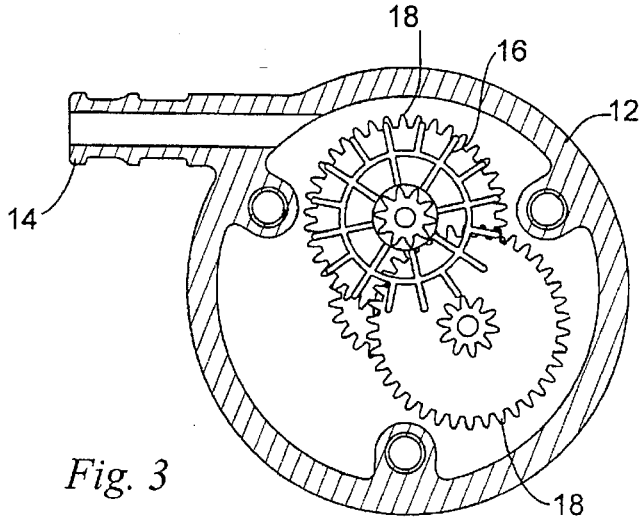
FIG. 3 is a side elevation view in part section, taken along line 3—3 of FIG. 2.
Figure 4:
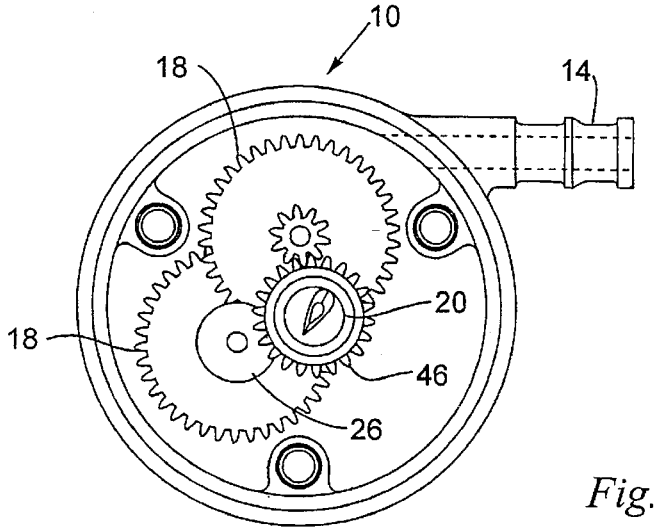
FIG. 4 is a plan view thereof, with the top cover removed for clarity of illustration.
Figure 5:
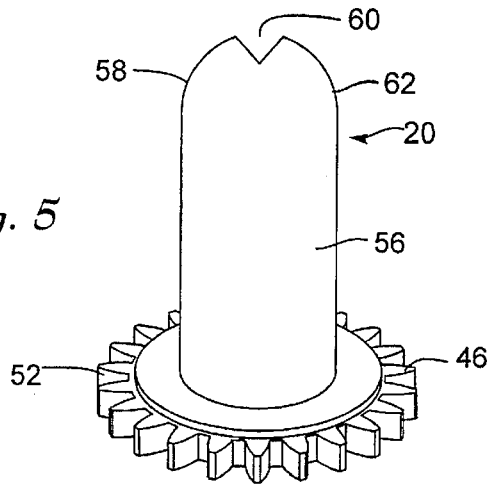
FIG. 5 is an enlarged perspective view of the rotary wash nozzle.

Turning in detail to the drawings, as shown in FIG. 1, the present fruit processing machine washer 10 includes a nozzle housing 12 with a housing wall 13 and a fluid inlet tube 14. The nozzle housing 12 has a generally cylindrical exterior surface shape and houses a rotary nozzle paddlewheel gear 16. As best seen in FIGS. 2 and 3, the rotary nozzle paddlewheel gear 16 is enmeshed with a combination gear 18. A plurality of combination gears 18 are provided, each enmeshed with another, effectively providing advantageous gear reduction. One of the combination gears 18 is enmeshed with a base gear 46 on the rotary wash nozzle 20, as best seen in FIG. 4. These components, as well as other components to be described may advantageously be made simply out of inexpensive materials such as stainless steel or plastic.

As shown in FIG. 1, the rotary nozzle paddlewheel gear 16 and combination gears 18 are mounted on gear mounting members 22, such as dowel pins, within the nozzle housing 12. Gear spacers 24 are provided to properly position the gears within the nozzle housing 12. In a preferred embodiment a spacer 26 is also used to ensure that rotary wash nozzle 20 is retained in proper position to engage only one combination gear 18.

A housing cap 28 is mounted to the nozzle housing 12 preferably with flathead screws 30. The housing cap 28 includes an opening 32 coincident with an opening 34 in the fruit processing equipment to be washed.

Figure 10:
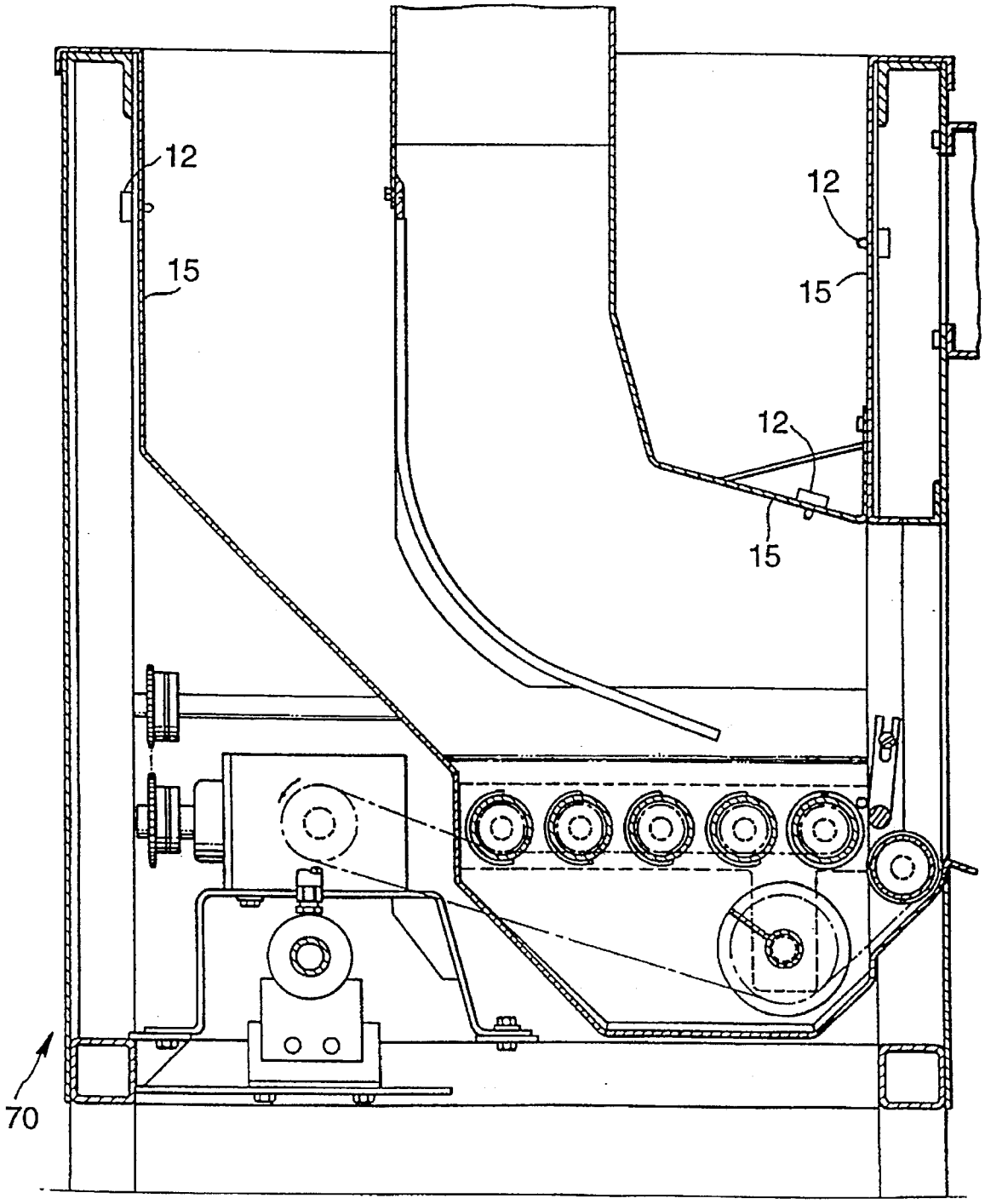
FIG. 10 is a section view of a fruit processing machine equipped with the washer of FIG. 1.

Referring to FIG. 10, fasteners hold the washer 10 to the walls 15 of equipment to be washed. The machine 70 shown in FIG. 10 is representative of a large class of machines to which the invention applies. The specific machine 70 in FIG. 10 is described in U.S. Pat. No. 4,421,021, incorporated by reference herein, as but one example. In a preferred embodiment, screws 36 extend through openings in the machine or equipment to be washed, through a gasket 38, and into the housing cap 28. The gasket 38 provides a fluid tight connection between the housing cap 28 and the inside surface of the machine walls or panels 15, to prevent leakage of juice around the nozzle housing, when the machine is in use.

The rotary wash nozzle 20 penetrates the housing cap 28 and the gasket 38 through the opening 34. A bushing 40 guides the rotary wash nozzle 20 and resists abrasion. As shown in FIG. 10, because the rotary wash nozzle 20 is relatively small, typically approximately one inch long, only a small portion of the rotary wash nozzle penetrates into the fruit processing spaces of the machine.

In a preferred embodiment, the gear teeth 44 on the rotary nozzle paddlewheel gear 16 are enmeshed with outer gear teeth 48 on a combination gear 18. Inner gear teeth 50 on a combination gear 18 are similarly enmeshed with outer gear teeth 48 on another combination gear 18. A plurality of combination gears 18 are enmeshed with each other. In the preferred embodiment, four combination gears 18 are enmeshed with each other, providing gear reduction, with each combination gear 18 providing a gear reduction of about 4 to 1. Other embodiments may advantageously use one to six combination gears 18. The last of the combination gears 18 providing gear reduction has its inner gear teeth 50 enmeshed with the base gear 46 on the rotary wash nozzle 20.

Turning now to FIGS. 5–9, the rotary wash nozzle 20 comprises a circular base 52 containing a cavity 54, gear teeth 46 around the perimeter of the base 52, and a hollow cylindrical body portion 56. The cavity 54 extends through the cylindrical body portion 56. A hemispherical crown 58 contains a first orifice 60 and a second orifice 62. The second orifice extends into the cylindrical body portion 56. The first orifice 60 cuts through the spherical crown 58 and has a generally tear-drop shape, as viewed from above. The second orifice 62 is a planer sector-shaped opening cut at an angle to the axis of rotation of the body 56.

In operation, wash water is pumped into the nozzle housing 12 through an inlet 14. The incoming wash water drives the paddles 42 causing the rotary nozzle paddlewheel gear 16 to rotate relatively rapidly, and to thereby drive the combination gears 18. Because of the effective gear reduction provided by enmeshing outer gear teeth 48 with inner gear teeth 50, each succeeding combination gear 18 will rotate more slowly than the preceding combination gear 18. The rotary wash nozzle 20 enmeshed with a combination gear 18 will also rotate at a relatively low rate. In a preferred embodiment the rotary wash nozzle 20 will rotate at approximately 5 to 10 revolutions per minute. This relatively low rotation rate advantageously provides high torque to the rotary wash nozzle 20, to help prevent dirt, sand, or other particles from jamming the rotary wash nozzle 20 against a wall or panel 15 of the machine.

After passing the paddlewheel gear 16, the water flows into the cavity 54 in the rotary wash nozzle gear 20. The wash water, under pressure, will then be forced through the first orifice 60 and second orifice 62. This creates a high impact spray on the walls 15 of the fruit processing machine. The two orifices provide a spray fan coverage through an arc of approximately 110 degrees. As the rotary wash nozzle 20 is rotated, as described above, the spray will completely cover an entire hemispherical region, dislodging and washing away skins, pulp, seeds, and other debris.

Figure 11:
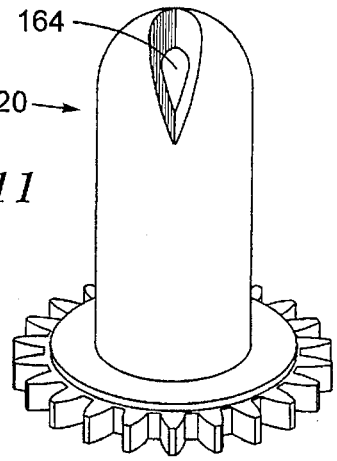
FIG. 11 is a an enlarged perspective view of a rotary wash nozzle containing a single orifice.
Figure 6:
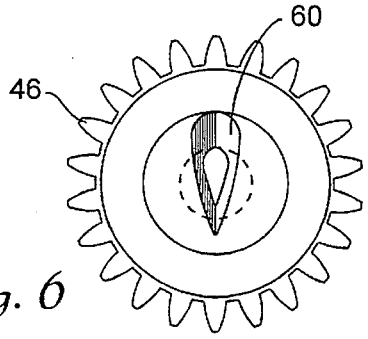
FIG. 6 is a top plan view of the rotary wash nozzle of FIG. 5.
Figure 7:
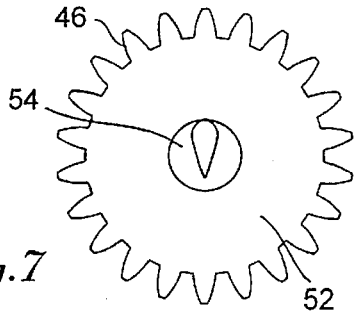
FIG. 7 is a bottom plan view of the rotary wash nozzle.
Figure 8A:
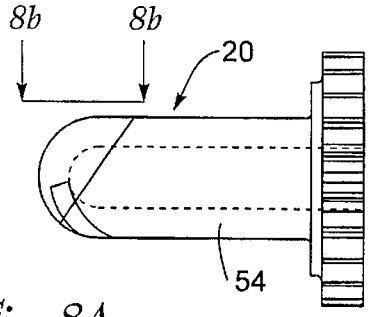
FIG. 8A is a side elevation view illustrating a first orifice in the rotary wash nozzle.
Figure 9A:
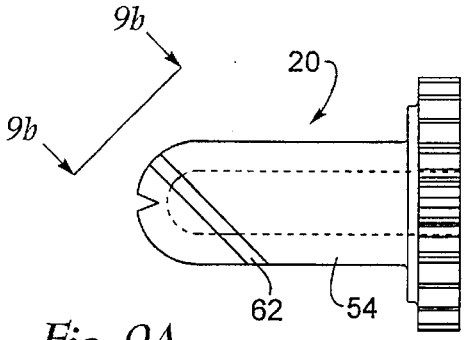
FIG. 9A is a side elevation view illustrating a second orifice in the rotary wash nozzle.
Figure 8B:
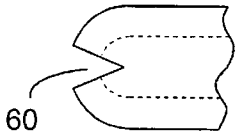
FIG. 8B is an elevation view taken along line 8*b*–8*b* in FIG. 8A.
Figure 12:
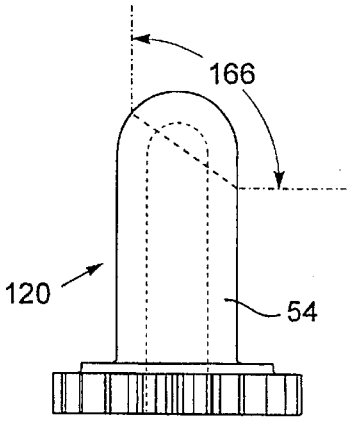
FIG. 12 is a side elevation view illustrating a water spray pattern emanating from the rotary wash nozzle of FIG. 11.
Figure 9B:
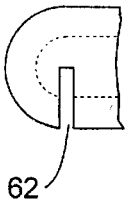
FIG. 9B is an elevation view taken along line 9*b*–9*b* in FIG. 9A.

As shown in FIGS. 11 and 12, in an alternate embodiment a rotary wash nozzle 120 has a single orifice 164, providing a spray pattern covering an arc 166 of about 90 degrees. As the rotary wash nozzle 120 is rotated, the arc 166 sweeps a hemispherical region.

The amount of water used by a single rotary wash nozzle 20 or 120 is similar to the amount of water used by a single fixed conventional nozzle. However, because the rotary wash nozzle 20 or 120 sprays an entire hemispherical region, or more, a single rotary wash nozzle cleans an area that would require numerous fixed conventional nozzles to clean. Additionally, because the rotary wash nozzle rotates relatively slowly, the sprayed wash water is concentrated on relatively small areas for relatively long periods of time, offering a thorough cleaning of the machine. Whereas perhaps hundreds of fixed nozzles might be required to clean a juice extractor, as few as only ten properly placed rotary wash nozzles may be required for certain machines.

For specific applications, the gear teeth 44 on the rotary nozzle paddlewheel gear 16 may be directly enmeshed with gear teeth 46 on the rotary wash nozzle, causing the rotary wash nozzle to rotate at a relatively higher rate. Other well known rotating mechanisms may also be used as equivalents to the gear drives shown and described.

Thus, a fruit processing machine washer is disclosed which provides high efficiency use of wash water, and requires the use of few wash nozzles. While embodiments and applications of this invention have been shown and described, it would be apparent to those skilled in the art that many more modifications are possible without departing from the inventive concepts herein.

What is claimed is:

1. A juice extractor equipment washer comprising:

a nozzle housing;

a fluid inlet tube connected to the nozzle housing;

a rotary nozzle paddlewheel gear rotatably mounted in the nozzle housing;

a plurality of combination gears mounted in the nozzle housing, at least one combination gear being enmeshed with the rotary nozzle paddlewheel gear, the remainder of the combination gears being enmeshed with each other to provide gear reduction; and a rotary wash nozzle mounted in the nozzle housing and enmeshed with at least one combination gear, the rotary wash nozzle comprising:

a circular base containing a cavity;

gear teeth encircling the perimeter of the circular base;

a hollow cylindrical body portion connected to the circular base, the cavity in the circular base extending into the cylindrical body portion;

a hemispherical crown portion connected to the cylindrical body portion; and a tear drop shaped orifice extending from the hemispherical crown portion to the hollow portion of the cylindrical body portion.

2. The juice extractor equipment washer of claim 1 wherein the number of combination gears ranges from 1 to 6.

3. The juice extractor equipment washer of claim 1 wherein the rotary wash nozzle further comprises a sector shaped planer spray nozzle opening in the cylindrical body portion.

4. A fruit processing machine washer comprising:

a nozzle housing attached to the machine;

a nozzle rotatably mounted in the nozzle housing, the nozzle comprising a cylindrical body, a hemispherical end connected to the cylindrical body, a tear drop shaped spray nozzle opening on the hemispherical end, and a sector shaped planer spray nozzle opening in the cylindrical body; and means for rotating the nozzle.

5. A juice extractor equipment washer comprising:

a nozzle housing;

a fluid inlet tube connected to the nozzle housing;

a rotary nozzle paddlewheel gear rotatably mounted in the nozzle housing; and a rotary wash nozzle mounted in the nozzle housing and enmeshed with the rotary nozzle paddlewheel gear, the rotary wash nozzle comprising:

a circular base containing a cavity;

gear teeth encircling the perimeter of the circular base;

a hollow cylindrical body portion connected to the circular base, the cavity in the circular base extending into the cylindrical body portion;

a hemispherical crown portion connected to the cylindrical body portion; and at least one orifice extending from the hemispherical crown portion to the hollow portion of the cylindrical body portion.

6. The juice extractor equipment washer of claim 5 wherein a plurality of combination gears are interposed between the rotary nozzle paddlewheel gear and the rotary wash nozzle with at least one combination gear being enmeshed with the rotary nozzle paddlewheel gear, at least one combination gear being enmeshed with the rotary wash nozzle; and the combination gears being enmeshed with each other to provide gear reduction.

7. The juice extractor equipment washer of claim 6 wherein the number of combination gears ranges from 1 to 6.

8. The juice extractor equipment washer of claim 6 wherein the gear reduction ratio of each combination gear is about 4 to 1.

* * * * *